US006120329A

United States Patent [19]

Steinman

[11] Patent Number: 6,120,329

[45] **Date of Patent: *Sep. 19, 2000**

[54] MODULAR JACK WITH ANTI-CROSS-TALK CONTACTS AND METHOD OF MAKING SAME

[75] Inventor: Joseph Steinman, Flower Mound, Tex.

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/075,038

[22] Filed: May 8, 1998

[51] Int. Cl.[7] ..... H01R 24/00

[52] U.S. Cl. ..... 439/676; 439/941

[58] Field of Search ..... 439/941, 676, 439/79

[56] References Cited

U.S. PATENT DOCUMENTS

| | | | |
|---|---|---|---|
| 4,577,921 | 3/1986 | Bogese, II | 439/676 |
| 5,085,601 | 2/1992 | Buchter et al. | 439/79 |
| 5,178,563 | 1/1993 | Reed | 439/676 |
| 5,186,647 | 2/1993 | Denkmann et al. | 439/395 |
| 5,362,257 | 11/1994 | Neal et al. | 439/676 |
| 5,399,107 | 3/1995 | Gentry et al. | 439/676 |
| 5,536,182 | 7/1996 | Atoh et al. | 439/941 |
| 5,586,914 | 12/1996 | Foster, Jr. et al. | 439/676 |
| 5,626,497 | 5/1997 | Bouchan et al. | 439/676 |
| 5,639,266 | 6/1997 | Patel | 439/941 |
| 5,647,770 | 7/1997 | Belopolsky | 439/676 |
| 5,674,093 | 10/1997 | Vaden | 439/676 |
| 5,687,478 | 11/1997 | Belopolsky | 29/884 |
| 5,702,271 | 12/1997 | Steinman | 439/676 |
| 5,727,957 | 3/1998 | Hashimoto et al. | 439/79 |
| 5,779,503 | 7/1998 | Tremblay et al. | 439/676 |
| 5,941,734 | 8/1999 | Ikeda et al. | 439/941 |

*Primary Examiner*—Paula Bradley
*Assistant Examiner*—Tho D. Ta

[57] ABSTRACT

An electrical connector for reducing cross-talk and a method for making same is disclosed herein. The connector is comprised of a plurality of conductors arranged in an array within a connector housing. In one embodiment, the conductors have a contact area that lies within a first plane. A first plurality of the conductors have a raised portion, and a second plurality of conductors have a lower portion. The raised portions of the first plurality of conductors are located in a second plane while the lower portions of the second plurality of conductors are located in a third plane. The first, second and third planes may be vertically spaced, or offset, from one another. Additionally, the raised portion and/or lower portion of any conductor may be laterally offset from one another.

12 Claims, 4 Drawing Sheets

MODULAR JACK WITH ANTI-CROSS-TALK CONTACTS AND METHOD OF MAKING SAME

BACKGROUND OF THE INVENTION

1. Field of the Invention

The present invention is directed to an electrical connector, and, more particularly, to an electrical connector for reducing cross-talk and a method for making same.

2. Description of the Related Art

Cross-talk can be generally described as the unwanted coupling of electrical signals on adjacent signal lines. Such cross-talk may result in portions of an electrical signal on one pair of lines appearing on a separate pair of lines as unwanted noise.

Cross-talk between different pairs of wires is a source of interference that can cause signal degradation and negatively impact the ability of a communication system to process incoming signals. Cross-talk can also increase error rates and reduce signal strength.

Problems associated with unwanted cross-talk are becoming even more problematic given the general increase in operating frequencies and data rates of modern communication systems. Additionally, cross-talk can be particularly problematic within electrical connectors that contain a plurality of wires that are generally parallel and spaced closely together—a configuration that may lead to excessive cross-talk even over short conductor lengths.

The present invention is directed to an electrical connector that solves or reduces some or all of the aforementioned problems.

SUMMARY OF THE INVENTION

In one embodiment, the connector is comprised of a plurality of conductors positioned within a housing. The conductors have a contact area adapted for mating electrical engagement with a mating plug. The contact areas of the conductors are positioned in a first horizontal plane. A first group of the conductors also have a raised portion, the raised portion of these conductors lies in a second horizontal plane that is vertically displaced from the first horizontal plane containing the contact areas of the conductors. The connector may also include a second group of conductors in which a portion of the conductors lies in a horizontal plane that is vertically displaced from the first and second horizontal planes discussed above.

The present invention is also directed to a method of manufacturing an electrical connector. The method comprises the step of forming a first plurality of conductors to have a contact area and a raised portion. The method further comprises positioning the first plurality of conductors within a connector housing such that the contact area of at least one of the first plurality of conductors is located in a first plane and the raised portion of the conductor is located in a second plane, the first and second planes being offset from one another.

BRIEF DESCRIPTION OF THE DRAWINGS

The invention may be understood by reference to the following description taken in conjunction with the accompanying drawings, in which like reference numerals identify like elements, and in which.

Figure 1:
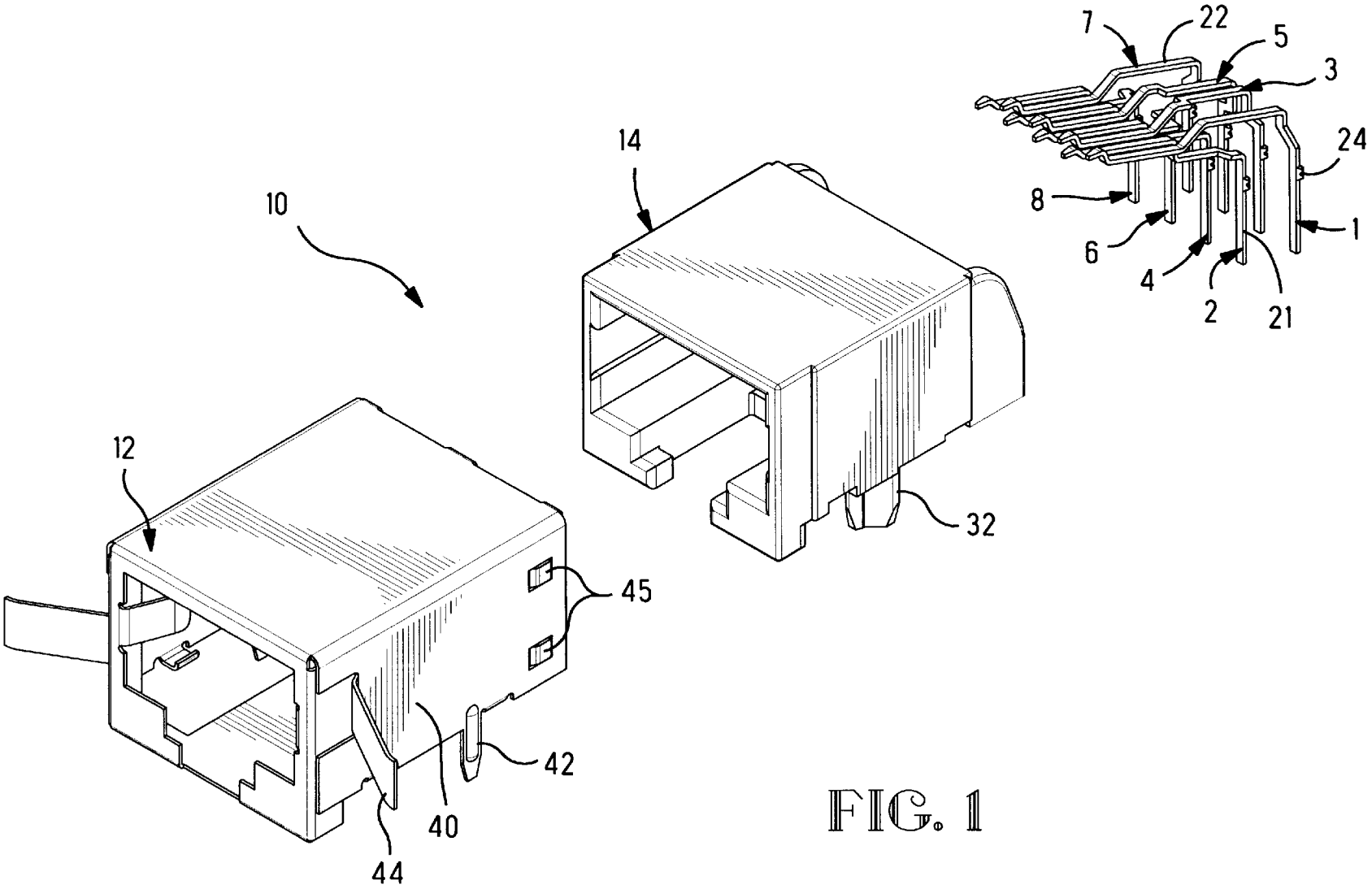
FIG. 1 is an exploded, front isometric view of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

An illustrative embodiment of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1A:
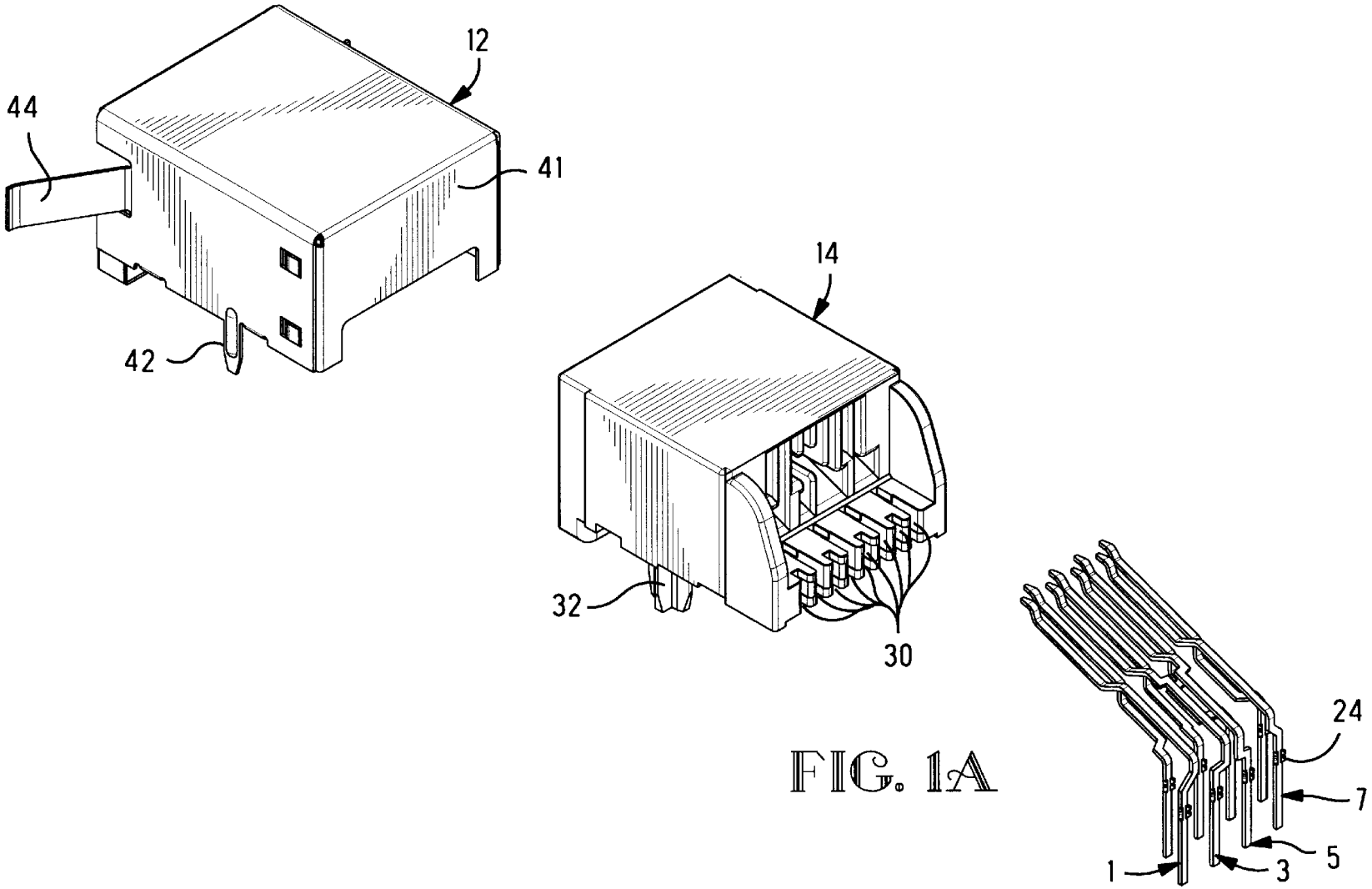
FIG. 1A is an exploded, rear isometric view of the present invention.
Figure 2:
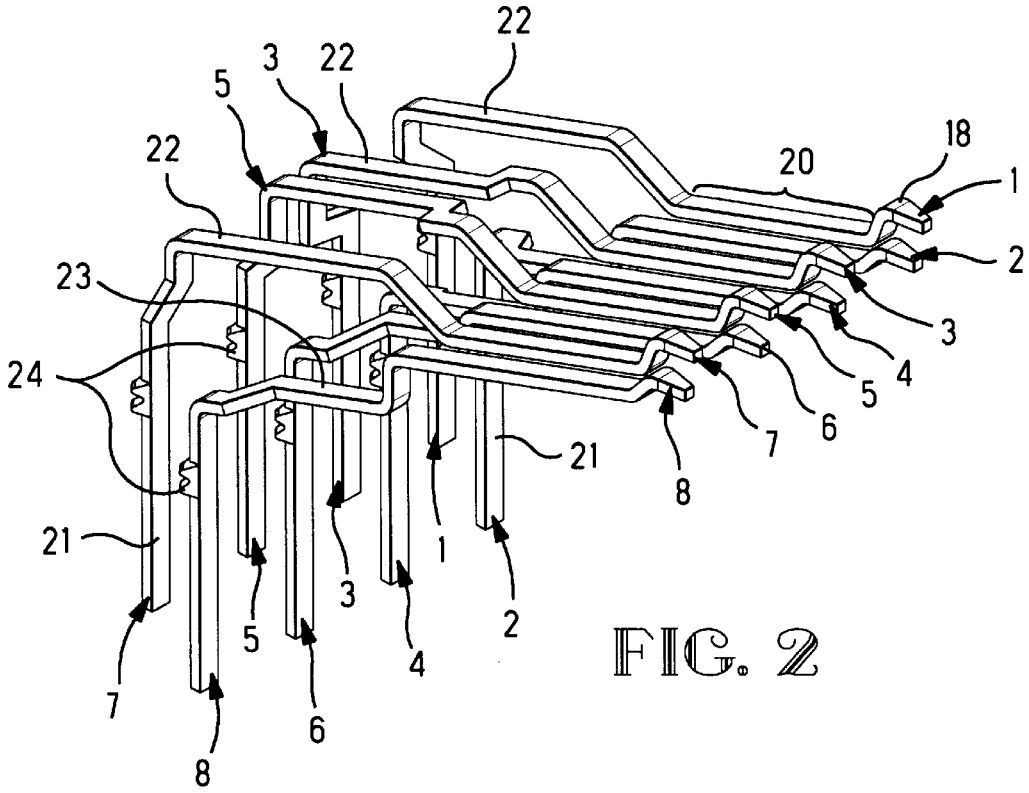
FIG. 2 is a isometric view of the electrical conductor array of the present invention.

With reference to FIGS. 1, 1A, and 2, the electrical connector 10 is generally comprised of an outer shield 12, a plastic housing 14, and a plurality of conductors 1–8. Each of the conductors 1–8 is associated with a particular signal line or wire. Electrical signals are transmitted over pairs of wires terminating in contacts of a plug connector (not shown) matable with connector 10. According to industry standards, the particular wires that are paired together are those for contact positions 1–2, 3–6, 4–5, and 7–8. While the present invention is illustrated using eight conductors, it is envisioned that the number of conductors could be varied to include more or less without departing from the spirit and scope of the invention.

Figure 3:
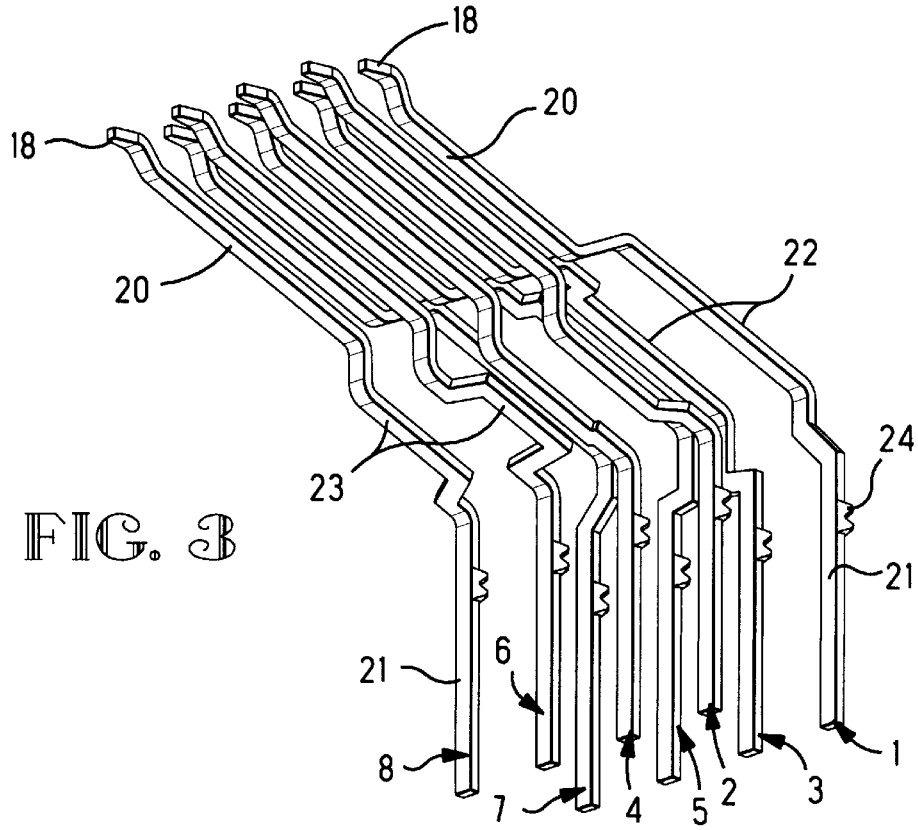
FIG. 3 is a bottom isometric view of the electrical connector of the present invention.
Figure 4:
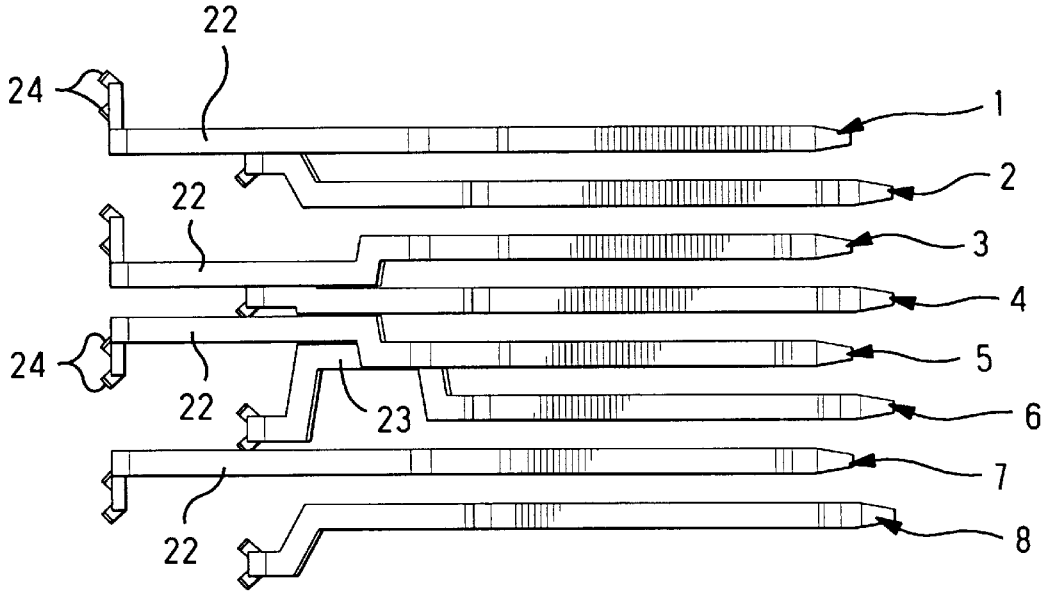
FIG. 4 is a top view of the electrical conductor array of the present invention.
Figure 5:
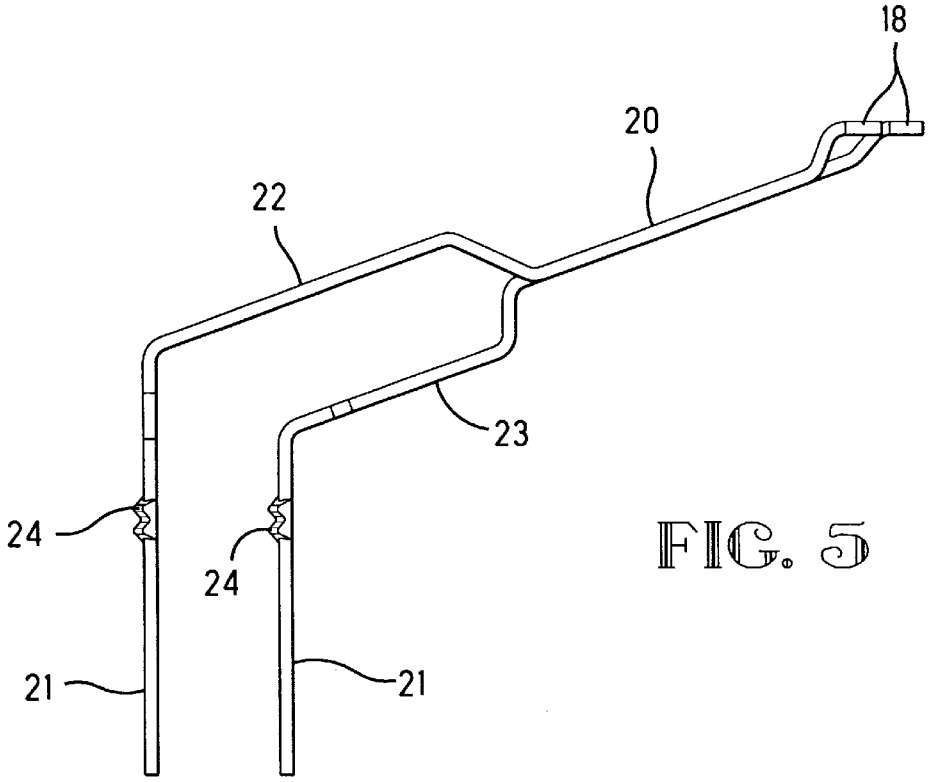
FIG. 5 is a side view of the electrical conductor array of the present invention.

Each of the conductors 1–8 is comprised of a tip 18, a contact area 20, a leg 21, and two retention barbs 24. First conductors 1, 3, 5, and 7 also have a raised portion 22 between contact area and leg 21. Second conductors 2, 4, 6, and 8 also have a lower portion 23 between contact area and leg 21. As can be seen in FIGS. 2, 3, and 5, the tips 18 of the first conductors 1, 3, 5, and 7 diverge vertically from the tips 18 of the second conductors 2, 4, 6, and 8.

The contact area 20 of the conductors 1–8 is adapted for electrical engagement with electrical contacts on a plug (not shown) that is to be inserted into the completed electrical connector. The contact area 20 of the conductors 1–8 is generally located in first plane. In one embodiment, the raised portions 22 of the conductors 1, 3, 5, and 7 and the lower portions 23 of the conductors 2,4, 6, and 8 are also located in separate second and third planes. The planes containing the raised portions 22 and lower portions 23 of the conductors are vertically spaced, or offset, from the plane containing the contact areas 20 of the electrical conductors 1–8.

As can be seen in FIGS. 1, 2, and 5, the raised portions 22 of the conductors and 5 are spaced horizontally closer together. Of course, it should be understood that it is not necessary for the raised portions 22 of conductors 3 and 5 to extend side-by-side for the full axial length of their raised portions in order to accomplish the objectives of the present invention. Additionally, as can be seen in FIG. 3, the lower portion 23 of the conductor 6 is spaced horizontally closer to the lower portion 23 of conductor 4. The downwardly depending legs 21 of the electrical conductors 1–8 are configured into two rows in a standard footprint for insertion into, for example, a printed circuit board (not shown).

The conductors 1–8 are adapted for insertion into housing 14, the conductors 1–8 are retained in recesses 30 formed in housing 14, by the two retention barbs 24 on each of the legs 21 of the conductors 1–8. Additionally, the tip 18 of each of the conductors is adapted for mechanical engagement with recesses (not shown) in the housing 14. After the electrical conductors 1–8 are inserted into the housing 14, the outer shield 12 is positioned over and secured to the housing 14. The outer shell 12 is generally comprised of body 40, rear panel 41, ground tabs 42, and panel ground tabs 44. After housing 14 is inserted into outer shell 12, rear panel 41 is folded down until clips on rear panel 41 engage recesses 45 in the outer shell 12. The completed electrical connector is attached to, for example, a printed circuit board by means of tabs 32.

The electrical conductors 1–8 are 0.475 mm wide, 0.25 mm thick, and are manufactured from phosphorous bronze. Of course, the particular cross-sectional area of the conductors 1–8 may be configured in any manner, for example, circular, without departing from the spirit of the present invention. The contact areas 20 of electrical conductors 1–8 are approximately 5 mm long, and the centerline spacing between the electrical conductors 1–8 in the contact area 20 is approximately 1.02 mm. The plane containing the raised portions 22 of conductors 1, 3, 5, and 7 is offset approximately 1.24 mm above the plane containing the contact areas 20 of conductors 1–8, and offset approximately 2.36 mm above the plane containing the lower portions 23 of conductors 2, 4, 6, and 8. The raised portion 22 of conductors 1, 3, 5, and 7 are approximately 5.59 mm in length. The lower portions 23 of conductors 2, 4, 6, and 8 are approximately 4.06 mm in length. The length of the portion of each of 1, 3, 5, and 7 extending between the contact area 20 and the raised portion 22 is approximately 1.45 mm. The length of the portion of the each of 2, 4, 6, and 8 extending between the contact area 20 and the lower portion 23 is approximately 0.64 mm. The centerline spacing between the raised portions 22 of conductors 3 and 5 is approximately 1.04 mm. The centerline spacing between the raised portions 22 of conductors 1 and 3 and conductors 5 and 7 is approximately 2.5 mm. The centerline spacing between the lower portions 23 of conductors 6 and 4 is approximately 1.04 mm. The centerline spacing between the lower portion 23 of conductors 2 and 4 and conductors 6 and 8 is approximately 2.03 mm and 3.01 mm, respectively, while that of conductors 4 and 6 is approximately 1.04 mm, since lower portion 23 of conductor 6 is laterally offset from its contact area 20 by approximately 0.98 mm.

In one embodiment, a method of manufacturing a connector comprises the following steps: forming a first plurality of conductors that have a contact area 20 and a raised portion 22; positioning at least one of the plurality of conductors such that the contact area 20 of the conductor lies in a first plane and the raised portion 22 of the conductor lies in a second plane; the first and second planes being vertically spaced, or offset, from one another; and positioning the conductors in an electrical connector housing 14.

The inventive method disclosed herein further comprises the following steps: forming a second plurality of conductors that have a contact area 20 and a lower portion 23; positioning at least one of the second plurality of conductors such that the contact area 20 lies in the first plane referenced above and the lower portion 23 lies in a third plane, the second and third planes being vertically spaced, or offset, from one another.

The inventive method also comprises forming at least one of the first plurality of conductors so that the raised portion 22 of the conductor is laterally offset from the contact area 20 of the conductor. The method further comprises forming at least one of the second plurality of conductors such that the contact area 20 is laterally offset from the lower portion 23 of the conductor. As can be seen in FIGS. 2 and 3, in one embodiment, the method includes: forming at least two conductors such that each of the conductors has a contact area 20 and a laterally offset raised portion 22, the contact areas 20 of the conductors lying in a first plane that is vertically spaced from a second plane containing the raised portions 23 of the conductors; forming at least one conductor having a contact area 20 and a laterally offset portion 23, the lower contact area 20 being located in a first plane and the lower portion 23 being located in a third plane; and positioning said conductors into an array in an electrical connector housing such that the first, second and third planes are vertically spaced, or offset, from one another.

The present invention may be manufactured without the need of using expensive and time-consuming insert molding techniques. The present invention can be made by preforming the outer shield 12 and housing 14, by any of a variety of known forming techniques, such as stamping, molding or casting, etc. The conductors 1–8 may be formed by any known technique, such as stamping to the desired shape, etc. Thereafter, the specially configured conductors may be inserted into the rear of the housing 14, either manually or automatically.

Conductors 1, 3, 5, 7 and 2, 4, 6, 8 may be kept attached to respective carrier strips (not shown) until after the conductors are inserted into the housing, after which the carrier strips are broken off.

The present invention is effective for reducing unwanted cross-talk. The planes containing the contact areas 20, raised portions 22 and lower portions 23 of the appropriate conductors to break up the parallelism within the electrical connector which, in turn, reduces the overall cross-talk of the electrical connector. Similarly, the tips 18 of the conductors 1–8 are also offset vertically to break up the parallelism of the connector. Of course, as is readily apparent, it is not absolutely necessary that all of the planes containing the contact area 20, raised portions 22 and lower portions 23 of the conductors 1–8 be vertically offset from one another in order to provide a connector that would reduce cross-talk. For example, the plane containing either the raised portions 22 or the lower portions 23 of the conductors could be positioned on the same plane that contains the contact areas 20 of the conductors 1–8.

Additionally, the configuration of the raised portion 22 of the conductors 3 and 5 and the configuration of lower portion 23 of conductor 6 also act to provide compensating cross-talk that reduces the overall cross-talk of the connector. That is, assuming that conductors 3 and 6 are the driven signal lines, at an initial time, there may be a positive electrical signal on conductor 6 and an equal amplitude, but opposite polarity, negative signal on line 3. In the contact area 20, conductor 6 will couple strongly to conductor 5 which will result in conductor 5 picking up some of the positive signal then present on conductor 6. In a similar manner, in the contact area 20, conductor 3 will couple strongly to conductor 4 which will result in conductor 4 picking up some of the negative signal then present on conductor 3.

The raised portion 22 of the conductor 3 is moved laterally closer to the raised portion 22 of the conductor 5 which will result in conductor 5 picking up some of the negative signal then present on line 3. In turn, this negative signal on conductor 5 will act to cancel or reduce the positive cross-talk signal induced on conductor 5 in the contact area 20 due to its proximity to conductor 6. Similarly, the lower portion 23 of conductor 6 is moved laterally closer to the lower portion 23 of conductor 4, resulting in conductor 4 picking up some of the positive, signal then present on conductor 6. In turn, this positive signal on conductor 4 will act to cancel or reduce the negative cross-talk induced on conductor 4 in the contact area 20 due to its proximity to conductor 3.

Performance testing on one embodiment of the present invention disclosed herein showed that the electrical connector disclosed herein is effective at reducing cross-talk. The tests were performed by mating the connector to a test plug which was qualified per TIA/EIA 568-A, Section B.2, TOC Test Method. The test plug had a cross-talk reading of 41.4 dB@ 100 MHz. The plug was then driven by a differential sinusoidal signal swept from 1 to 100 MHz, which was applied to the driven pair. The noise coupled from the driven pair to the victim pair was measured and recorded as detailed in the following table:

| Driven Pair | Victim Pair | Cross-Talk @ 100 MHz |
|---|---|---|
| 4 & 5 | 3 & 6 | −40.7 dB |
| 3 & 6 | 1 & 2 | −48.4 dB |
| 3 & 6 | 7 & 8 | −46.3 dB |
| 4 & 5 | 7 & 8 | −66.3 dB |
| 1 & 2 | 4 & 5 | −66.2 dB |
| 7 & 8 | 1 & 2 | −69.4 dB |

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An electrical connector comprising: a housing and multiple electrical conductors in side by side positions, 1, 2, 3, 4, 5, and 6, within the housing, the conductors extending between opposite ends and being without change in the order of said positions at each of the opposite ends, the conductors in the positions 3 and 6 transmitting simultaneous first and second signals of opposite polarity, the conductors in the positions 3 and 4 having corresponding relatively farther apart portions to reduce cross talk that would be induced in the conductor in the position 4 by the first signal, the conductors in the positions 4 and 6 having corresponding relatively closely spaced portions to induce cross talk in the conductor in the position 4 by the second signal that would cancel the cross talk that would be induced by the first signal, the conductors in the positions 5 and 6 having corresponding relatively farther apart portions to reduce cross talk that would be induced in the conductor in the position 5 by the second signal, and the conductors in the positions 3 and 5 having corresponding relatively closely spaced portions to induce cross talk in the conductor in the position 3 by the second signal, which would cancel the cross talk that would be induced by the first signal.

2. An electrical connector as recited in claim 1 wherein, the corresponding relatively farther apart portions of the conductors in the consecutive positions 3 and 4 extend in spaced apart, first and second planes, respectively.

3. An electrical connector as recited in claim 1 wherein, the corresponding relatively closely spaced portions of the conductors in the positions 4 and 6 are parallel and coplanar.

4. An electrical connector as recited in claim 1 wherein, the corresponding relatively farther apart portions of the conductors in the consecutive positions 5 and 6 extend in spaced apart, first and second planes, respectively.

5. An electrical connector as recited in claim 1 wherein, the corresponding relatively closely spaced portions of the conductors in the positions 3 and 5 are parallel and coplanar.

6. An electrical connector as recited in claim 1 wherein, the corresponding relatively spaced apart portion of the conductor in the position 3 is parallel and coplanar with the corresponding relatively closely spaced portion of the conductor in the position 5, and the corresponding relatively spaced apart portion of the conductor in the position 4 is parallel and coplanar with the corresponding relatively closely spaced portion of the conductor in the position 6.

7. An electrical connector as recited in claim 6 wherein, the corresponding relatively spaced apart portion of the conductor in the position 3 and the corresponding relatively closely spaced portion of the conductor in the position 5 are in a first plane, and the corresponding relatively spaced apart portion of the conductor in the position 4 and the corresponding relatively closely spaced portion of the conductor in the position 6 are in a second plane that is offset from the first plane.

8. An electrical connector comprising: a housing, alternating first and second adjacent electrical conductors in the housing, the first and second conductors extending between opposite ends and being without change in the order of their positions in the housing at each of the opposite ends, the first conductors having offset portions extending offset in a first direction, the second conductors having offset portions extending offset in a second direction that is opposite to the first direction to reduce cross talk of a first polarity that would be induced between the first and second conductors, and whereby to cancel said cross talk of the first polarity that would be induced, the offset portions of the first conductors being relatively closely spaced to induce cross talk of a second polarity therebetween, and the offset portions of the second conductors being relatively closely spaced to induce cross talk of a second polarity therebetween.

9. An electrical connector as recited in claim 8 wherein, the offset portions of the first conductors are relatively closely spaced in a first plane to induce cross talk therebetween, and the offset portions of said second conductors are relatively closely spaced in a second plane to induce cross talk therebetween.

10. An electrical connector as recited in claim 8 wherein, the offset portions of the first conductors are offset in said first direction to extend in a first plane, the offset portions of the second conductors are offset in said second direction to extend in a second plane that is offset from the first plane, the offset portions of the first conductors are further offset toward each other to be relatively closely spaced to induce cross talk therebetween, and the offset portions of the second conductors are further offset toward each other to be relatively closely spaced to induce cross talk therebetween.

11. An electrical connector as recited in claim 8 wherein, the offset portions of the first conductors are offset in said first direction to extend in a first plane, the offset portions of the second conductors are offset in said second direction to extend in a second plane that is offset from the first plane, the offset portions of the first conductors are further offset toward each other to be relatively closely spaced to induce cross talk therebetween, and the offset portions of the second conductors are further offset toward each other to be relatively closely spaced to induce cross talk therebetween.

12. A method of manufacturing an electrical connector, comprising the steps of:

providing first conductors with offset portions extending offset in a first direction, providing second conductors with offset portions extending offset in a second direction that is opposite to the first direction to reduce cross talk of a first polarity that would be induced between the first and second conductors, assembling the first conductors and the second conductors in alternating order in a housing, whereby to cancel said cross talk of the first polarity that would be induced, the first conductors and the second conductors extending between opposite ends and being without change in the order of their positions in the housing at each of the opposite ends, positioning the offset portions of the first conductors relatively closely spaced to induce cross talk of a second polarity therebetween, and positioning the offset portions of the second conductors relatively closely spaced to induce cross talk of a second polarity therebetween.

* * * * *